US005088148A

United States Patent [19]

Hernandez

[11] Patent Number: 5,088,148

[45] Date of Patent: Feb. 18, 1992

[54] CLEANING MOP APPARATUS

[76] Inventor: Luis R. Hernandez, 1125 E. Sonora Ave., Glendale, Calif. 91201

[21] Appl. No.: 594,719

[22] Filed: Oct. 5, 1990

[51] Int. Cl.[5] ..... A47L 13/24

[52] U.S. Cl. ..... 15/228; 15/147 R; 15/147 B; 15/231

[58] Field of Search ..... 15/147 R, 147 A, 147 B, 15/148, 151, 153, 228, 231-233, 119 R

[56] References Cited

U.S. PATENT DOCUMENTS

| | | | |
|---|---|---|---|
| D. 138,041 | 6/1944 | Kautenberg | 15/153 X |
| 979,834 | 12/1910 | Ean | 15/153 |
| 1,223,464 | 4/1917 | Andersch et al. | 15/153 |
| 1,794,048 | 2/1931 | Wright | 15/147 R |
| 1,904,774 | 4/1933 | Baker | 15/231 X |
| 1,973,779 | 9/1934 | Raney | 15/231 X |
| 2,320,291 | 5/1943 | Moskowitz | 15/153 |
| 2,380,128 | 7/1945 | Trindl | 15/119 R X |
| 2,691,183 | 10/1954 | Osaka | 15/153 X |
| 3,469,274 | 9/1969 | Snapp | 15/228 |

*Primary Examiner*—Edward L. Roberts
*Attorney, Agent, or Firm*—Leon Gilden

[57] ABSTRACT

An apparatus is set forth including a support housing of an arcuate configuration complementarily having secured within a concave surface of a housing in a complementary manner, an elongate support cylinder. The support cylinder includes a slot directed through the cylinder aligned with a rear edge of the support housing, with the slot securing an elongate flexible cleaning pad for permitting directing of the cleaning pad over a surface to be sanitized and cleaned.

2 Claims, 3 Drawing Sheets

PRIOR ART 10
11
12
13
15
16
17
18
19
20
20a
21
21a
22
23
24
25

CLEANING MOP APPARATUS

BACKGROUND OF THE INVENTION

1. Field of the Invention

The field of invention relates to cleaning mop apparatus, and more particularly pertains to a new and improved cleaning mop apparatus wherein the same provides a convenient and readily manipulatable organization permitting ease of replacement and maintenance of cleaning pads utilized.

2. Description of the Prior Art

Mops of various types have been utilized in the prior art. The mop of the instant invention attempts to overcome deficiencies of the prior art by providing a sturdy and readily manipulatable mop utilizing a flexible cleaning pad as a mopping member to effect cleaning. Examples of the prior art include U.S. Pat. No. 4,481,688 to Graham wherein a cleaning mop utilizes a latch structure to effect ease of mounting of a mop head therewithin, wherein the mop head is of a generally elongate "T" shaped configuration.

Similarly, U.S. Pat. Nos. 4,516,287 to Johnson; 4,654,920 to O'Neil, Jr., et al.; and 4,333,198 to Vosbikian set forth sponge mop arrangements utilizing a generally "T" shaped sponge head, wherein the organizations utilize various manners of wringing of the mop head structure.

U.S. Pat. No. 3,806,982 to Park is another example of a mop head utilizing a support base, with a sponge member and a brush, with the brush mounted to a forward edge of the support base and the sponge member mounted to a bottom surface thereof.

As such, it may be appreciated that there continues to be a need for a new and improved cleaning mop apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cleaning mop apparatus now present in the prior art, the present invention provides a cleaning mop apparatus wherein the same provides an organization utilizing convenient and readily replacement flexible cleaning pads. As such, the general purpose of the present invention, which will be described subsequently in greater detail, is to provide a new and improved cleaning mop apparatus which has all the advantages of the prior art cleaning mop apparatus and none of the disadvantages.

To attain this, the present invention provides an apparatus setting forth a support housing of an arcuate configuration complementarily having secured within a concave surface of a housing in a complementary manner, an elongate support cylinder. The support cylinder includes a slot directed through the cylinder aligned with a rear edge of the support housing, with the slot securing an elongate flexible cleaning pad for permitting directing of the cleaning pad over a surface to be sanitized and cleaned.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cleaning mop apparatus which has all the advantages of the prior art cleaning mop apparatus and none of the disadvantages.

It is another object of the present invention to provide a new and improved cleaning mop apparatus which may be easily and efficiently manufactured and marketed.

It is a further object of the present invention to provide a new and improved cleaning mop apparatus which is of a durable and reliable construction.

An even further object of the present invention is to provide a new and improved cleaning mop apparatus which is susceptible of a low cost of manufacture with regard to both materials and labor, and which accordingly is then susceptible of low prices of sale to the consuming public, thereby making such cleaning mop apparatus economically available to the buying public.

Still yet another object of the present invention is to provide a new and improved cleaning mop apparatus which provides in the apparatuses and methods of the prior art some of the advantages thereof, while simultaneously overcoming some of the disadvantages normally associated therewith.

Still another object of the present invention is to provide a new and improved cleaning mop apparatus wherein the same utilizes a readily mounted support cylinder to permit ease of replacement and replenishment of cleaning pads utilized by the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
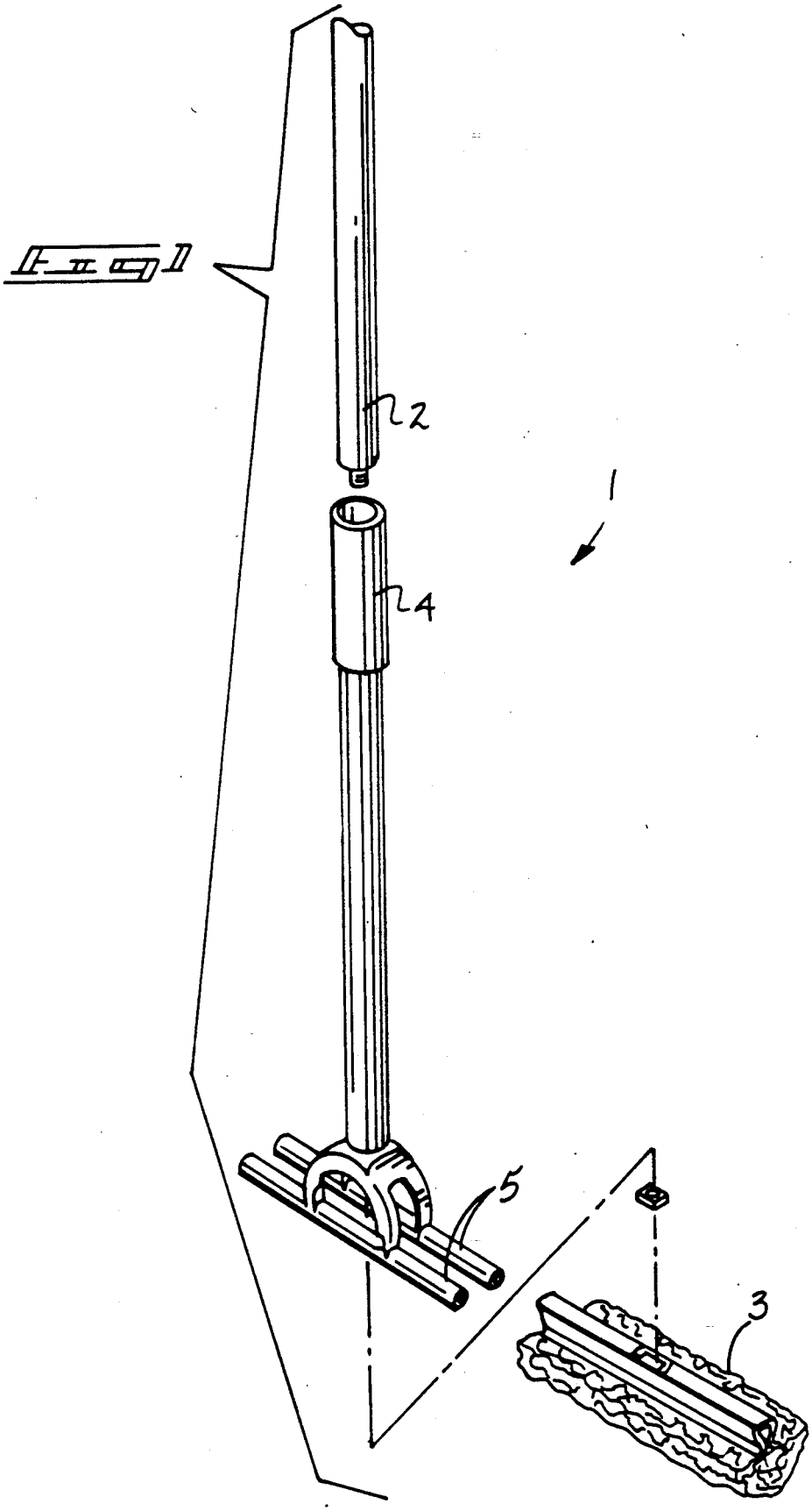
FIG. 1 is an isometric illustration of a prior art cleaning mop assembly.
Figure 2:
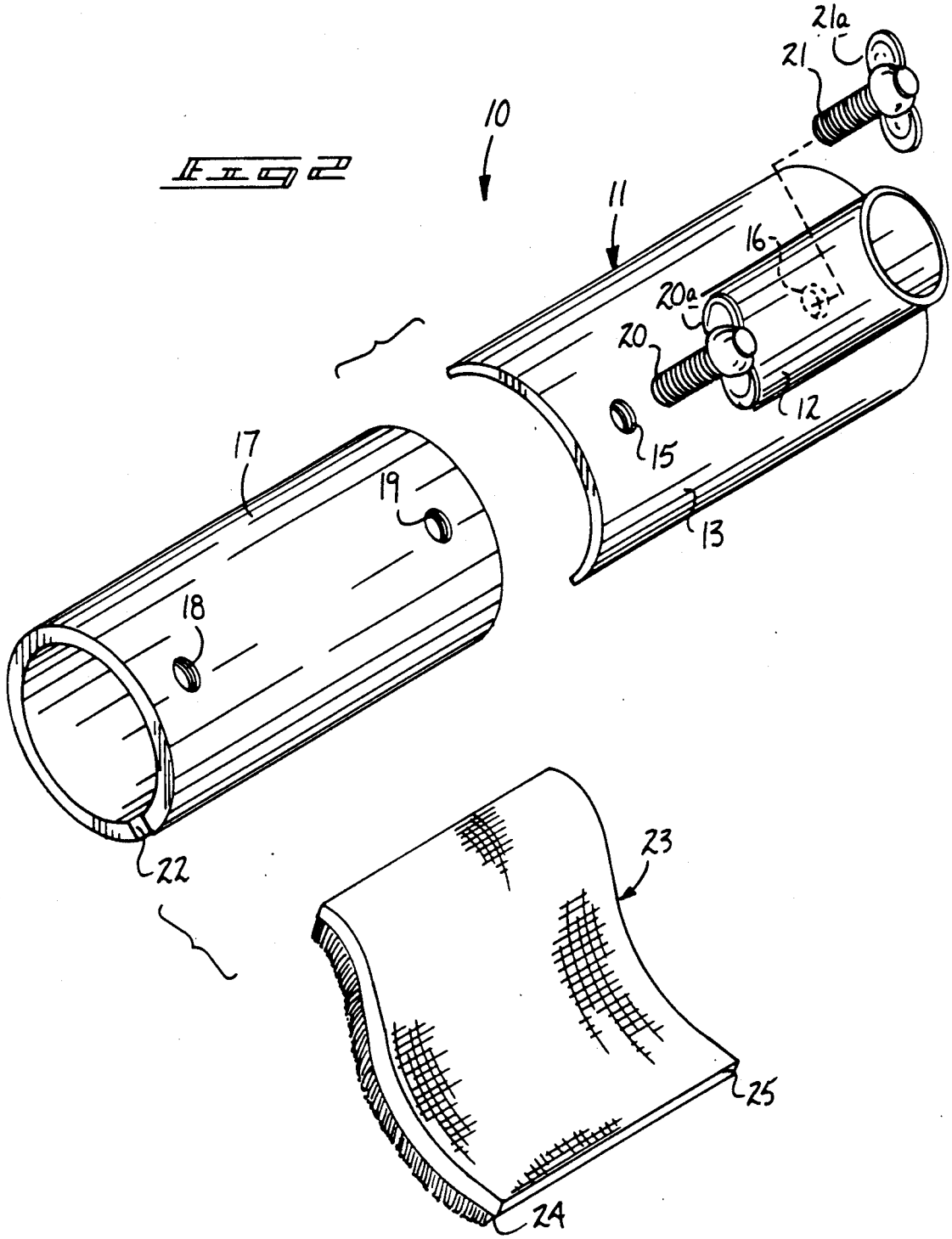
FIG. 2 is an isometric illustration of the instant invention.
Figure 3:
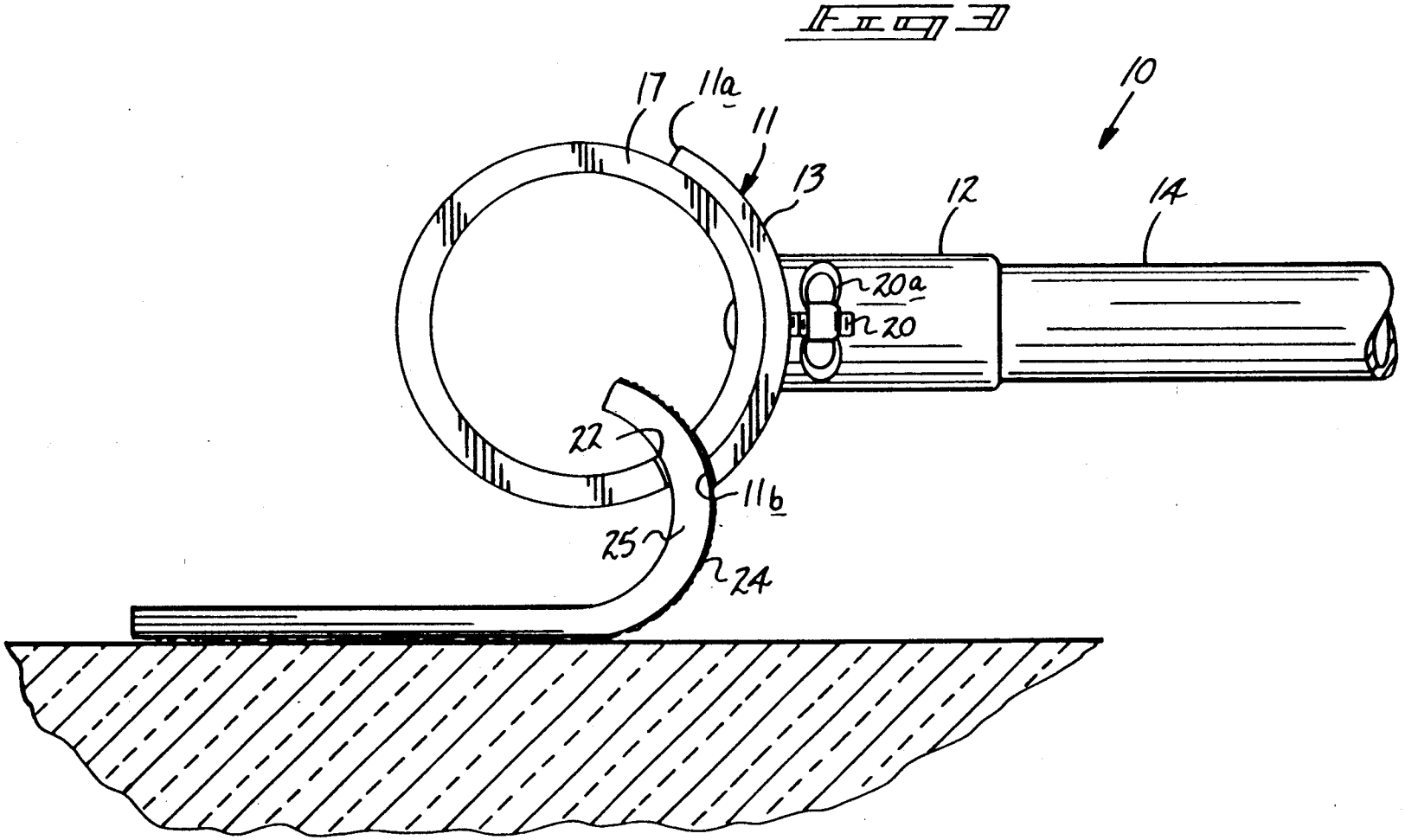
FIG. 3 is an orthographic side view of the instant invention in an assembled configuration.

With reference now to the drawings, and in particular to FIGS. 1 to 3 thereof, a new and improved cleaning mop apparatus embodying the principles and concepts of the present invention and generally designated by the reference numeral 10 will be described.

FIG. 1 illustrates a prior art cleaning mop assembly 1, wherein a handle 2 is mounted to spaced rods 5 that receive a "T" shaped sponge head 3 therebetween, with a slider 4 to effect repositioning of a sponge head between the rods 5 to effect a wringing thereof, in a manner as set forth in U.S. Pat. No. 4,333,198.

More specifically, the cleaning mop apparatus 10 of the instant invention essentially comprises an elongate support housing 11 of a semi-cylindrical shell configuration defining an arc of less than 180 degrees, with a tubular mounting socket 12 diametrically and medially mounted in a fixed relationship to a housing exterior surface 13. An elongate handle rod 14 (see FIG. 3) is secured in a fixed relationship during use within the socket 12. A respective first and second threaded support opening 15 and 16 spaced apart a predetermined spacing are through-extending the housing 11 in diametric alignment to each side of the socket 12 to permit fastening of the support cylinder 17 defined by a predetermined length equal to the predetermined length of the support housing 11. The support cylinder 17 includes a respective first and second support cylinder aperture 18 and 19 spaced apart the predetermined spacing for alignment with the respective first and second threaded support openings 15 and 16. A respective first and second threaded shaft 20 and 21 are directed through the first and second support cylinder apertures 18 and 19 and the respective first and second threaded support openings 15 and 16, in a manner as illustrated in FIG. 3 for example, to secure the assembly together, with each respective threaded shaft 20 and 21 utilizing a respective first and second fastener **20*a* and 20*b* to provide final securement of the assembly. A slot 22 is coextensively directed through the support cylinder 17 and upon assembly, a rear edge 11*b* of the support housing 11 will overlie the slot 22 to effect clamping of an elongate flexible cleaning pad 23 within the slot 22. It is noted that the support housing 11 includes a forward edge 11*a*, wherein in certain circumstances, the forward free end of the flexible cleaning pad 23 may be tucked under the support housing 11 to clamp the flexible pad between the support housing 11 and the support cylinder 17. The flexible cleaning pad 23 includes an abrasive exterior first side 24 and a sponge base 25, whereupon the pad 23 may be reversed in use to effect positioning of the sponge base 25 for contact with a surface to be cleaned, in a manner as set forth in FIG. 3**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cleaning mop apparatus comprising, a support housing defined by a predetermined length, the housing including an elongate support cylinder defined by the predetermined length arranged for selectively mounting to the support housing, and mounting means for selectively mounting the support cylinder to the support housing, and the support housing including a tubular mounting socket fixedly and orthogonally mounted medially to the support housing to an exterior surface thereof, and the support cylinder including an elongate flexible cleaning pad selectively mounted to the support cylinder, and wherein the support housing includes a first and second threaded support opening formed in the support housing spaced apart a predetermined spacing, with each of the first and second threaded support openings mounted on opposed sides of the mounting socket, and an elongate handle rod securable within the mounting socket, and wherein the support cylinder includes a respective first and second support cylinder aperture, wherein the first and second support cylinder apertures are spaced apart the predetermined spacing and the mounting means include a first and second threaded shaft, with the first threaded shaft directed through the first threaded support opening and the first support cylinder aperture, and the second threaded shaft directed through the second threaded support opening and the second support cylinder aperture to secure the support cylinder to the support housing, and including a respective first and second fastener threadedly mounted to the respective first and second threaded shaft exteriorly of the support housing to secure the support housing to the support cylinder, and wherein the support cylinder includes an elongate slot coextensively directed through the support cylinder, the support cylinder formed of a tubular construction, and the support housing defined by a semi-cylindrical shell defining an arc of less than 180 degrees, with the support housing including a forward edge and a rear edge, and the rear edge overlying the slot when the support cylinder is mounted to the support housing.

2. An apparatus as set forth in claim 1 wherein the flexible cleaning pad includes an abrasive first side coextensively formed over a sponge base, with the flexible cleaning pad securable within the slot when the support cylinder is mounted within the support housing.

* * * * *